US006544088B1

(12) United States Patent
Dubois

(10) Patent No.: US 6,544,088 B1
(45) Date of Patent: Apr. 8, 2003

(54) SELF ADJUSTING NEUTRAL BUOYANCY COUNTERMEASURE AND SYSTEM

(75) Inventor: Neil J. Dubois, Cranston, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/977,905

(22) Filed: Oct. 10, 2001

(51) Int. Cl.[7] ..... B63B 22/16
(52) U.S. Cl. ..... 441/6
(58) Field of Search ..... 114/312, 125; 441/6, 7, 11, 21, 28, 29

(56) References Cited

U.S. PATENT DOCUMENTS 5,899,204 A * 5/1999 Cochran ..... 128/205.23
6,142,092 A * 11/2000 Coupland ..... 114/331

* cited by examiner

*Primary Examiner*—Ed Swinehart
(74) *Attorney, Agent, or Firm*—James M. Kasischke; Michael F. Oglo; Jean-Paul Nasser

(57) ABSTRACT

An underwater self adjusting displacement device includes a sealed housing having an exterior wall and an inner component area, the exterior wall having an opening formed therein. A sealing plug is slidably seated in the opening of the exterior wall, and an actuator mechanism selectively adjusts the sealing plug within the opening, thereby adjusting a total displacement of the sealed housing. The displacement device is incorporated into any substantially neutrally buoyant underwater deployable device such as an acoustic countermeasure device or an oceanographic sensor device. Further, the deployable devices may be deployed individually or as a field due. The displacement device requires less weight and weight within an overall deployed device, enabling large deployments and performance enhancements.

11 Claims, 3 Drawing Sheets

SELF ADJUSTING NEUTRAL BUOYANCY COUNTERMEASURE AND SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

This invention generally relates to a self adjusting neutral buoyancy countermeasure and system for underwater devices.

More particularly, the invention relates to a self adjusting neutral buoyancy mechanism which effects slight changes in an overall displacement of an underwater body, and thereby adjusts a buoyancy force of the body.

(2) Description of the Prior Art

The current art for devices required to maintain certain depths is known. These include military devices such as torpedo countermeasures and oceanographic survey devices. Acoustic countermeasures are particularly utilized to confuse hostile sonar systems and protect existing force assets. Typical countermeasures are launched from a submarine platform and use an active system to traverse to a predetermined depth, maintain a hovering depth, and begin operation. The known military devices utilize a propeller system or a variable pressure gasbag system to maintain a predetermined depth; however, these systems require active manipulation to maintain their position. In general the devices themselves are slightly negatively buoyant, thus requiring a means of providing additional upward force to maintain depth and prevent the device from free-falling to the ocean bottom.

A propeller system for an acoustic countermeasure device 10 is shown by way of example in FIG. 1. In the case of FIG. 1, constant power is used to maintain the thrust that holds the device 10 at a predetermined depth D. The device 10 is comprised of a body tube 12 which houses power and electronics, a transducer section 14 which produces the acoustic power, and a hovering system 16 which provides thrust and keeps the device at the prescribed depth D in the underwater environment 18. Thus, a problem exists in the art whereby the space and energy requirements for deploying and maintaining depth of one or more underwater devices, such as an acoustic countermeasure device, should be minimized.

This invention describes a countermeasure as a single device and as a system which encompasses the traditional acoustic traits of countermeasures along with a novel hovering system and the use of multiple numbers of these countermeasure devices simultaneously. The invention disclosed here is designed to work on a body that is essentially neutrally buoyant by design, and requires only slight changes to effect depth control. Further, the invention herein utilizes a more passive device for maintaining a predetermined depth which takes less volume, weight and power than traditional methods. The savings in weight, volume and power should allow for a device design that is essentially neutrally buoyant on its own, thus requiring only small changes in buoyancy to effect depth change.

The following patents, for example, disclose various types of depth adjusting devices, but do not disclose a novel hovering mechanism allowing a submerged device to adjust and to maintain a desired depth as does the present invention.

U.S. Pat. No. 2,790,186 to Carapellotti;

U.S. Pat. No. 4,286,539 to Pignone; and

U.S. Pat. No. 4,364,325 to Bowditch.

Specifically, Carapellotti discloses a buoy having an upper enclosed chamber housing a weight therein and a lower chamber joined to the upper chamber. The lower chamber has an open end remote from the upper chamber and a weight therein adapted to pass through the opening. A first removable closure member and a second closure member are provided for the opening, the second closure member being disposed in the lower chamber above the weight. Flexible means connect the weight and the second closure member, and orifices are provided in the lower chamber near the top thereof. When the first closure member is removed from the opening and the buoy is floated, the weight will pass through the opening and be suspended beneath the buoy by the flexible means, the second closure member will lodge on and seal the opening, and the lower chamber will become substantially filled with water.

The patent to Pignone discloses a dual buoyancy device having two external dimensions, in the smaller of which, one end is closed by an elastic sheet undistended, and in the greater of which the sheet is distended from its normal position thereby increasing the external dimension of the device. The distention of the sheet is accomplished by a thruster member bearing on the sheet which thruster is impelled by a weight and lever system actuated by gravity, which causes the thruster to distend the sheet. When the sheet is distended, the overall volume increases causing the device to float. When the sheet is undistended, the overall volume decreases causing the device to sink. Distension of the sheet via the thruster only occurs when the device is inverted. Still further, there is no neutral buoyancy capability. The device either sinks or floats.

Bowditch discloses a passive near neutral buoyancy platform including a structure housing a series of gas-filled cells, restrained in their maximum volume regardless of the internal charge pressure, and collapsible in character when external pressure exceeds the charge pressure. With this structure, once a cell having a predetermined initial internal charge pressure reaches a depth where the external pressure exceeds this initial value, that cell contracts, resulting in a net buoyancy change for the structure. Where this series of cells is attached integrally to a single structure, the cells form a pre-loaded compressibility compensation device matched to the external environment.

It should be understood that the present invention would in fact enhance the functionality of the above patents by providing a displacement mechanism for an underwater body in which the displacement mechanism changes the total displacement of the body and thereby a adjusts a buoyancy force of the body. This is done in the present invention on a substantially neutrally buoyant device and without the use of a known propeller system or a variable pressure gas bag system.

SUMMARY OF THE INVENTION

Therefore it is an object of this invention to provide a self adjusting neutral buoyancy device.

Another object of this invention is to provide a self adjusting neutral buoyancy device deployed as a system of devices.

Still another object of this invention is to provide a self adjusting neutral buoyancy device having a mechanism for changing a sealed volume of the device and thereby adjusting a depth at which neutral buoyancy occurs.

A still further object of the invention is to provide a self adjusting neutral buoyancy device which may be incorporated into any underwater neutrally buoyant device.

Yet another object of this invention is to provide a self adjusting neutral buoyancy device which is less costly and requires less space than known devices.

In accordance with one aspect of this invention, there is provided an underwater self adjusting displacement device including a sealed housing having an exterior wall and an inner component area, the exterior wall having an opening formed therein. A sealing plug is slidably seated in the opening of the exterior wall, and an actuator mechanism selectively adjusts the sealing plug within the opening, thereby adjusting a total displacement of the sealed housing. The displacement device is incorporated into any substantially neutrally buoyant underwater deployable device such as an acoustic countermeasure device or an oceanographic sensor device. Further, the deployable devices may be deployed individually or as a field. The displacement device requires less weight and weight within an overall deployed device, enabling large deployments and performance enhancements.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to a mechanism which allows for a submerged device to adjust and maintain a certain depth. Examples of devices which are required to remain submerged at specific depths include military devices such as torpedo countermeasures and oceanographic devices which float submerged for long periods of time and map ocean currents. This invention accomplishes a volumetric displacement change in a submerged body which can alter and maintain floating at a certain depth.

The invention is a mechanism to adjust and maintain depth for a submerged underwater device. It is designed to operate on a device which is essentially neutrally buoyant and requires only slight changes in its displacement/buoyancy to effect depth control. The variable density of seawater due to pressure as depth increases allows for bodies to float at a constant depth beneath the surface. Slight changes in the body's overall displacement can affect its buoyancy, and thereby its depth. This mechanism allows for changing the total displacement of a body and thereby an adjustment in buoyancy force.

Figure 2:
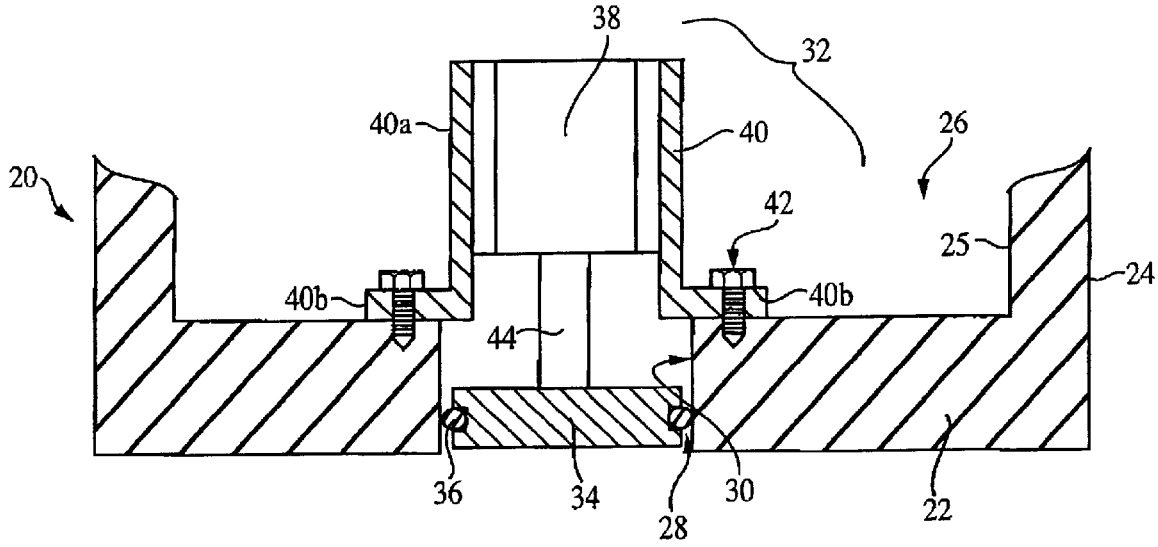
FIG. 2 is a side sectional view of a buoyancy displacement device according to a preferred embodiment of the present invention.

Turning now to FIG. 2, a first preferred embodiment of a displacement device 20 is shown. It will be understood from the following that the described displacement device 20 is applicable to a number of end uses such as the acoustic countermeasure device or oceanographic devices which float submerged for long periods of time and map ocean currents. These end uses are mentioned by way of example only and are not intended to limit the end uses of the present invention.

The displacement device 20 includes a shell or body portion 22, the body portion 22 being closed and sealed to provide a displacement of seawater and resulting buoyancy force. The body portion 22 has an outer surface 24 in contact with the sea water, and an inner wall surface 25 defining an inner chamber 26 for housing components of the displacement device 20. An opening 28 is formed through the body portion 22, the opening being defined by an inner wall surface 30. A displacement mechanism 32 is provided in connection with and sealed against the opening 28 of the body portion 22. The displacement mechanism 32 is sealed with the opening 28 so as to preserve the watertight integrity of the displacement device 20 as will be further described in the following.

The displacement mechanism 32 particularly includes a plug member 34 having an outer peripheral shape corresponding to the shape of the inner wall surface 30. The plug member 34 is sealed against the wall surface 30 with an O-ring seal 36 therearound. This seal 36 slides with the plug 34 to create a change in the overall displacement of the underwater device 20.

This sliding motion of the plug 34 and seal 36 is created by a linear actuator 38 mounted to the inner surface 25 of the body portion 22 by a bracket 40 and bolts 42. An actuator shaft 44 is interconnected between the actuator 38 and the plug 34 and allows for controllable motion to be imparted from the actuator 38 to the plug 34. The bracket 40 is shown as having a flange 40*b* extending radially from a central shaft type housing 40*a*. The flange 40*b* is flush with the inner surface 25 of the body 22 adjacent the opening 28. Although the bracket 40 having the housing 40*a* and flange 40*b* is illustrated, it should be appreciated that the bracket 40 may be of any suitable shape and attached in any known manner to the inner surface 25 of the body portion 22 of the device. Further, although the displacement device 20 is shown to utilize cylindrical parts for the plug 34 and the opening 28, these shapes are not intended to limit the invention.

Figure 3:
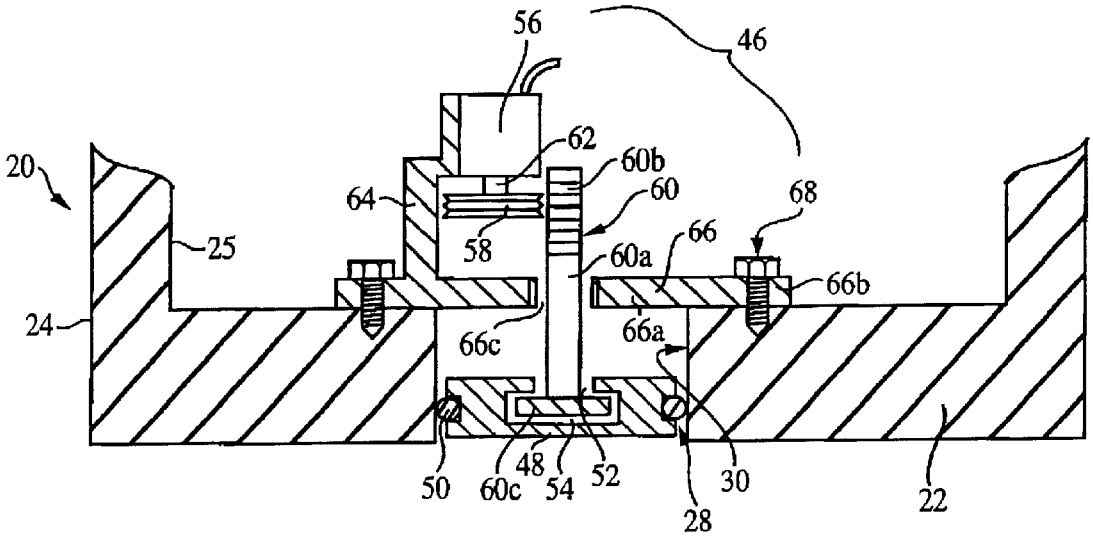
FIG. 3 is a side sectional view of a buoyancy displacement device according to a further preferred embodiment of the present invention.

Turning now to FIG. 3, an alternative displacement mechanism 46 is shown as another preferred embodiment. Like reference numbers refer to like parts throughout this specification. Accordingly, the body portion 22 having an opening 28 with an inner wall surface 30 formed therein remains the same as in FIG. 2. A displacement plug 48 is located concentrically within the opening 28 of the body 22 and includes an O-ring seal 50 formed therearound. The displacement plug 48 is formed to include an opening 52 on an inner surface thereof, the opening terminating in a cavity 54 within the plug 48 as shown.

The displacement plug 48 along with its seal 50 slides within the wall surface 30 of the body portion 22 to create a change in the overall displacement of the underwater device 20. This sliding motion of the plug 48 and seal 50 is created by a motor 56, a drive gear 58, and a power screw 60 engaged with drive gear 58. The motor 56 is connected to the drive gear 58 with an intermediary shaft 62. The power screw 60 includes an elongated shaft portion 60*a* having gear threads 60*b* at one end thereof and a plate 60*c* attached to the other end thereof. The plate portion 60*c* is seated within the cavity 54 of the displacement plug 48 such that the displacement plug 48 moves in response to movement of the plate portion 60*c*. Rotation of the drive gear 58 translates to linear movement of the power screw 60 by engagement of the drive gear 58 with the threads 60*b* of the power screw 60. Power screw 60 and plate portion 60*c* can rotate when moved by drive gear 58 without requiring rotation of plug 48 and seal 50. These incremental linear movements of the power screw 60 generate a corresponding motion of the plug 48 and seal 50. Other means of achieving the translation of the seal plug 48, such as by use of a worm gear and rack or the like, may be affected by one of ordinary skill in the art and is intended to be included within the scope of the invention.

Similar to the embodiment of FIG. 2, the assembly is fixed to the inner surface of the body 22 with a bracket 64, 66 and bolts 68. The bracket assembly includes a substantially vertical bracket portion 64 and a substantially horizontal bracket portion 66. The vertical bracket portion 64 supports the motor 56 of the displacement mechanism and the horizontal bracket portion 66 is flush with the inner surface 25 of the body for mounting thereto with the bolts 68. At least a portion of the horizontal bracket 66 extends as an inner flange 66a to cover the opening 28 of the body portion 22, such that the power screw 60 fits through an opening 66c thereof as shown. An outer flange portion 66b of the horizontal bracket 66 is used to attach the bracket to the inner surface 25 of the shell 22.

Adjustments of the plug 48 position in the opening 28 of the shell 22 changes the overall buoyancy of the device 20 since the displacement changes while the overall weight of the device remains constant.

With the invention as described in FIGS. 2 and 3, there is achieved a controllable change in depth for an underwater floating device 20 through a small change in buoyancy. This is done in a manner to only consume very small quantities of energy to effect the change. Also, once the depth is attained, no further changes to the system are required to maintain near term depth and the system becomes truly passive. For extended time durations, movement of the device to water of different temperature or salinity may require further active adjustments.

Figure 4:
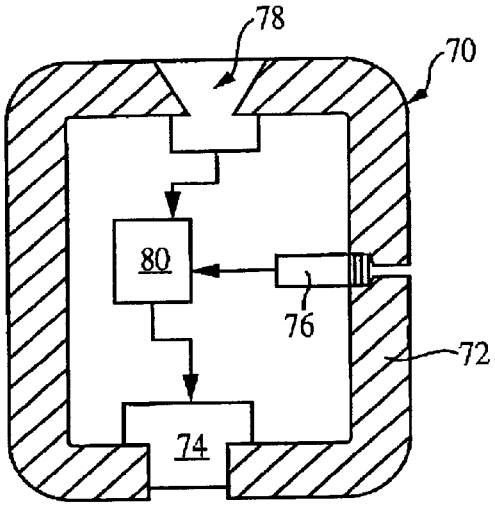
FIG 4 is a side sectional view of a generic underwater device for use with the preferred embodiments of the present invention.

Referring now to FIG. 4, there is shown a generic underwater device 70 having a shell type body portion 72 as described in connection with FIGS. 2 and 3. The body portion 72 is assumed to be closed and sealed, providing a displacement of seawater and resulting buoyancy force. Positioned within the device 70 is a displacement mechanism 74 such as that described in connection with either of FIG. 2 or 3. The displacement mechanism 74 is sealed against the shell 72 to preserve watertight integrity. Also located within the shell body 72 are a pressure sensor 76, a salinity meter 78, and a controller 80. Other instrumentation such as accelerometers or motion detectors can also be provided and joined to controller 80. By using the inputs of the pressure sensor 76 as a measure of depth and the salinity meter 78 as a measure of salt content (which affects buoyancy) the controller 80 can monitor the environmental variables and adjust the system through a commanded position for the displacement mechanism 74.

The displacement mechanism 74 functions in the same manner as described in either of FIG. 2 or 3. The system 70 utilizes commercial components for depth pressure sensing and salinity measurements. A control algorithm developed to relate pressure, salinity, and position control of the displacement mechanism in order to achieve and maintain a prescribed depth can be implemented using a relatively simple control circuit. Power can be supplied through a battery, and likely would be supplied by whatever power source is energizing the device's other functions.

Figure 5:
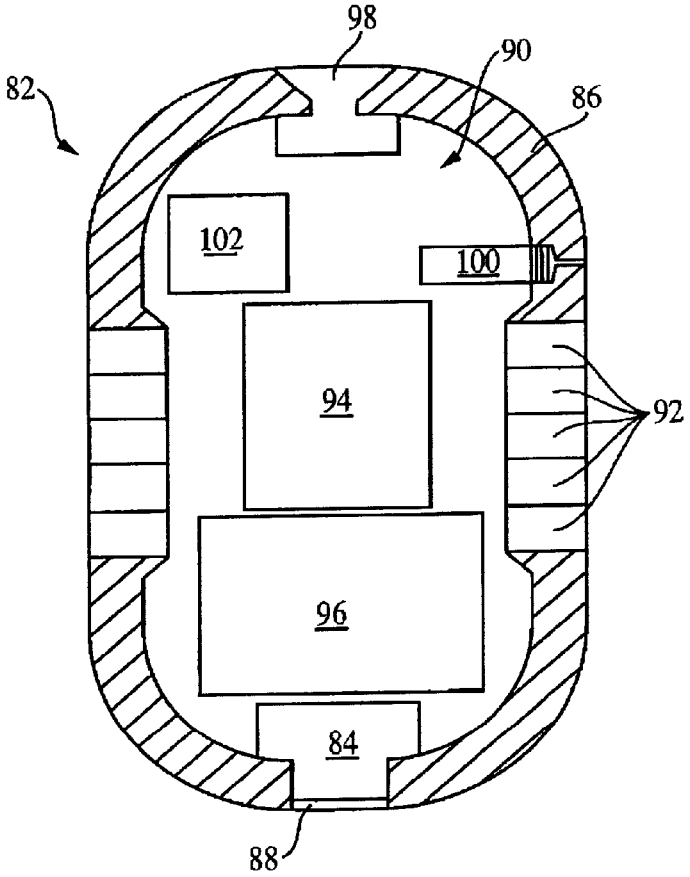
FIG. 5 is a side sectional view of an acoustic countermeasure device for use with the preferred embodiments of the present invention.

Referring next to FIG. 5, there is illustrated an acoustic countermeasure device 82 utilizing a displacement mechanism 84 according to the present invention as described in either of FIG. 2 or 3.

The acoustic countermeasure 82 is utilized as a decoy and jammer in undersea warfare. Acoustic signals are transmitted which can confuse the sonar systems of hostile torpedoes and submarines. Similar to the previous figures, the acoustic countermeasure device 82 includes a shell type body 86 having an opening 88 therein for receiving the displacement mechanism 84. The shell body 86 includes an interior chamber 90 for accommodating operating elements of the device 82. As shown in the FIG. 5, transducers 92 are mounted on or in the walls of the shell body 86 and produce the acoustic signals. A battery power source 94 and signal electronics 96 are located within the chamber 90 and provide the power and signals for driving the transducers 92. These systems are similar to current acoustic systems used in countermeasure devices.

Similar to that of FIG. 4, the acoustic countermeasure device 82 includes a salinity meter 98 and a pressure sensor 100. A controller 102 coordinates the information gathered from the salinity meter 98 and pressure sensor 100 in a manner identical to that described above for FIG. 4. This system incorporates the traditional acoustic transducers and electronics which supply the sound into the water which is the product of an acoustic countermeasure. The details will be eliminated herein for brevity.

Figure 1:
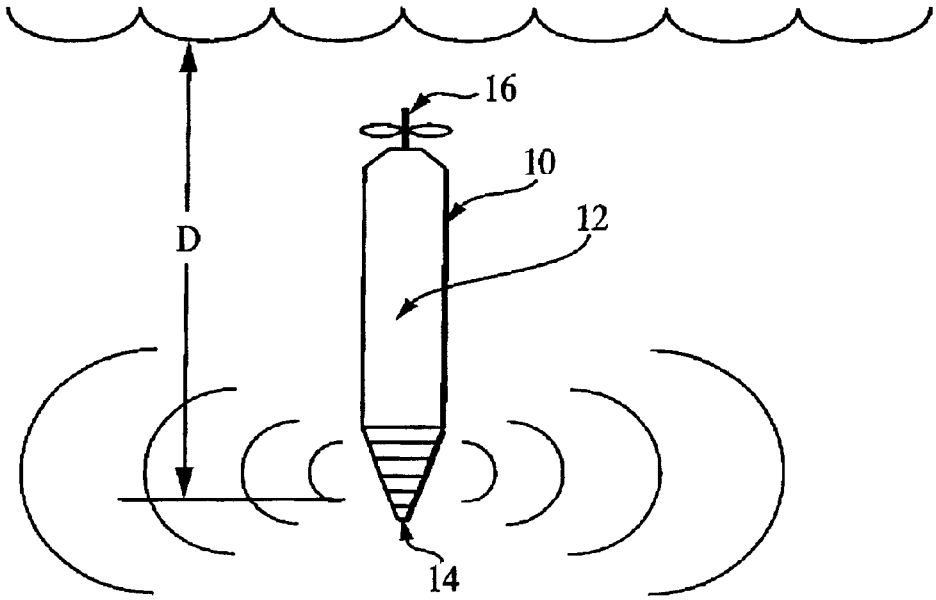
FIG. 1 (PRIOR ART)
FIG. 1 is a side view of an underwater acoustic countermeasure device according to the Prior Art.
Figure 6:
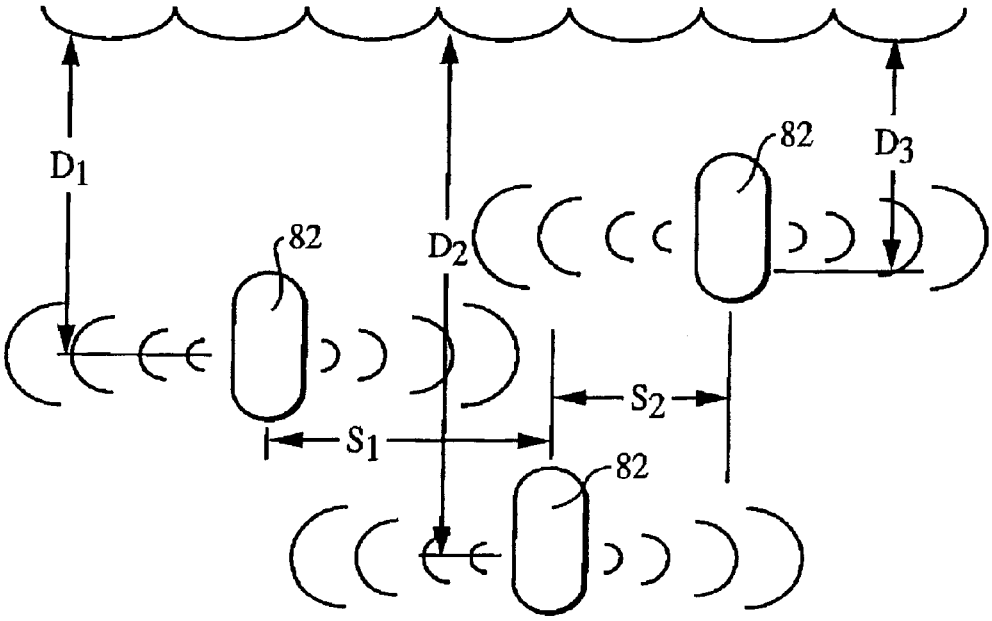
FIG. 6 is a side view of a field of countermeasure devices deployed simultaneously according to the present invention.

Referring now to FIG. 6, a field of acoustic countermeasure devices 82 is shown to be deployed as a substantially simultaneous event. Due to the volume saved by the novel buoyancy system, it is anticipated that multiple countermeasure devices can be launched using the volume previously required for a single device. As such, the application of simultaneously dispersed fields of countermeasures becomes an available option. These countermeasures can all be set to hover at different depths (D1, D2, D3). Additionally, delays in launching while the launch platform is in motion will provide spatial separations (S1, S2). The net effect is a series of acoustic sources at different depths and locations. This can cause a threat weapon or platform to rule out multiple sources as decoys rather than one. If the countermeasures 82 are employing different frequency bands in their transmissions, additional processing problems for the threat assets arise. Incorporated into each of the countermeasures 82 of FIG. 6 is the novel displacement mechanism of FIG. 2 or 3 to achieve and maintain a prescribed depth of the individual countermeasures which together make up the system. The variable density of seawater due to pressure as depth increases and changes in temperature allows for bodies to float at a constant depth beneath the surface. Slight changes in the body's overall displacement can affect its buoyancy, and thereby its depth.

This system allows for changing the total displacement of a body and thereby an adjustment in buoyancy force to achieve and maintain a desired depth by an underwater device.

The arrangement of FIG. 6 is advantageous in that it provides a multiple acoustic countermeasure system which presents multiple acoustic sources/frequencies to confuse incoming threats.

Through an acoustic countermeasure system as described, the overall device may be made smaller than traditional devices due to the weight, volume, and power savings afforded by the novel depth control system. This may make available the option to package two devices into the launch apparatus currently used to deploy one device.

The exact number of countermeasures used in the multiple countermeasure system can vary. The number available and mission specifics will affect launch numbers and individual depth/frequency assignments.

The tolerance for depth accuracy and the time duration of the device mission can alter the control system components. If a short duration mission is required, and the area of the ocean known, then the need to measure and monitor salinity is reduced and this aspect of the control system could be omitted. Further, the specific mission of the countermeasure will influence the choice of transducers and the requisite power levels.

In view of the above detailed description, it is anticipated that the invention herein will have far reaching applications other than those of underwater systems such as acoustic countermeasures and oceanographic devices.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An underwater self adjusting displacement device comprising:

a sealed housing having an exterior wall and an inner component area, the exterior wall having an opening formed therein;

a sealing plug slidably seated in the opening of the sealed housing exterior wall;

an actuator mechanism joined to move said sealing plug for selectively adjusting said sealing plug within the sealed housing opening, thereby adjusting a total displacement of said housing;

a pressure sensor joined to said sealed housing and exposed to external fluid for determining an underwater depth of said device;

a salinity meter joined to said sealed housing and exposed to external fluid for determining a salinity of said water; and a controller in communication with said pressure sensor, said salinity meter and said actuator mechanism for controlling said actuator mechanism and said sealing plug in response to data from said pressure sensor and said salinity meter;

wherein said actuator mechanism comprises:

a linear actuator joined to said controller;

a shaft joined between said linear actuator and said sealing plug; and a bracket fixed to an inner surface of said sealed housing supporting said actuator mechanism.

2. The device according to claim 1 wherein said sealing plug is shaped to conform to the opening of the exterior wall.

3. The device according to claim 2 wherein said sealing plug comprises:

a plug portion slidably positioned in said sealed housing opening; and a sealing washer positioned around the perimeter of the plug portion between said plug portion and said sealed housing.

4. An underwater self adjusting displacement device comprising:

a sealed housing having an exterior wall and an inner component area, the exterior wall having an opening formed therein;

a sealing plug slidably seated in the opening of the sealed housing exterior wall;

an actuator mechanism joined to move said sealing plug for selectively adjusting said sealing plug within the sealed housing opening, thereby adjusting a total displacement of said housing;

a pressure sensor joined to said sealed housing and exposed to external fluid for determining an underwater depth of said device;

a salinity meter joined to said sealed housing and exposed to external fluid for determining a salinity of said water; and a controller in communication with said pressure sensor, said salinity meter and said actuator mechanism for controlling said actuator mechanism and said sealing plug in response to data from said pressure sensor and said salinity meter;

wherein said actuator mechanism comprises:

a motor joined to said controller;

a drive gear connected to and rotated by said motor;

a power screw having thread portions engaged with said drive gear at a first end thereof and connected to said sealing plug at an opposing end thereof; and a bracket fixed to an inner surface of said sealed housing supporting said motor.

5. The device according to claim 4 wherein:

said sealing plug has a cavity formed within said sealing plug and an opening formed in a surface of said sealing plug in communication with said cavity;

said power screw further including a plate member fixed to said power screw opposing end, said plate member being positioned within said sealing plug cavity, said plate member contacting said sealing plug for moving said sealing plug.

6. An underwater self adjusting displacement device comprising:

a sealed housing having an exterior wall and an inner component area, the exterior wall having an opening formed therein;

a sealing plug slidably seated in the opening of the sealed housing exterior wall;

an actuator mechanism joined to move said sealing plug for selectively adjusting said sealing plug within the sealed housing opening, thereby adjusting a total displacement of said housing;

a pressure sensor joined to said sealed housing and exposed to external fluid for determining an underwater depth of said device;

a salinity meter joined to said sealed housing and exposed to external fluid for determining a salinity of said water;

a controller in communication with said pressure sensor, said salinity meter and said actuator mechanism for controlling said actuator mechanism and said sealing plug in response to data from said pressure sensor and said salinity meter;

a plurality of transducer elements positioned within said sealed housing in communication with environmental fluid wherein at least one of said plurality of transducer elements receives acoustic signals from said environmental fluid and transmits said received acoustic signals to said signal electronics;

a power source positioned within said sealed housing and joined to said controller; and signal electronics joined to said power source, said controller and said transducers, said signal electronics transmitting characteristics of said received acoustic signals to said controller, and said controller further controlling said signal electronics in response to data from said pressure sensor and said salinity meter for driving said plurality of transducers.

7. The device according to claim 6 wherein said sealing plug is shaped to conform to the opening of the exterior wall.

8. The device according to claim 7 wherein said sealing plug comprises:

a plug portion slidably positioned in said sealed housing opening; and a sealing washer positioned around the perimeter of the plug portion between said plug portion and said sealed housing.

9. The device according to claim 6 wherein said actuator mechanism comprises:

a linear actuator joined to said controller;

a shaft joined between said linear actuator and said sealing plug; and a bracket fixed to an inner surface of said sealed housing supporting said actuator mechanism.

10. The device according to claim 6 wherein said actuator mechanism comprises:

a motor joined to said controller;

a drive gear connected to and rotated by said motor;

a power screw having thread portions engaged with said drive gear at a first end thereof and connected to said sealing plug at an opposing end thereof; and a bracket fixed to an inner surface of said sealed housing supporting said motor.

11. The device according to claim 10 wherein:

said sealing plug has a cavity formed within said sealing plug and an opening formed in a surface of said sealing plug in communication with said cavity;

said power screw further including a plate member fixed to said power screw opposing end, said plate member being positioned within said sealing plug cavity, said plate member contacting said sealing plug for moving said sealing plug.

* * * * *